US009404289B2

(12) United States Patent
Sayegh et al.

(10) Patent No.: US 9,404,289 B2
(45) Date of Patent: Aug. 2, 2016

(54) ANTI-THEFT DEVICE

(75) Inventors: Adel O. Sayegh, Rancho Cucamonga, CA (US); Edgardo Redublo, Chino Hills, CA (US); Yuequn Lu, Hangzhou (CN); Yinghong He, Hangzhou (CN)

(73) Assignee: Universal Surveillance Systems, LLC, Rancho Cucamonga, CA (US)

( * ) Notice: Subject to any disclaimer, the term of this patent is extended or adjusted under 35 U.S.C. 154(b) by 9 days.

(21) Appl. No.: 13/398,737

(22) Filed: Feb. 16, 2012

(65) Prior Publication Data

US 2012/0204608 A1 Aug. 16, 2012

Related U.S. Application Data

(60) Provisional application No. 61/443,697, filed on Feb. 16, 2011.

(51) Int. Cl.
*E05B 73/00* (2006.01)

(52) U.S. Cl.
CPC ..... *E05B 73/0017* (2013.01); *Y10T 70/411* (2015.04)

(58) Field of Classification Search
CPC ..... E05B 73/0017; E05B 73/0052; G08B 13/2434; Y10T 70/411
USPC ..... 70/19, 57, 57.1, 58, 262, 233–236; 24/303, 525, 569; 340/572.8, 572.9
See application file for complete search history.

(56) References Cited

U.S. PATENT DOCUMENTS 524,872 A * 8/1894 Stephen ..... 24/347
4,616,384 A * 10/1986 Lowell et al. ..... 24/335
4,903,383 A * 2/1990 Gartshore ..... 24/706.8
5,068,641 A * 11/1991 Hogen Esch ..... 340/551
5,144,820 A * 9/1992 Holmgren ..... E05B 3/0035 351/111
5,365,758 A * 11/1994 Shieh ..... 70/33
5,379,618 A * 1/1995 Shieh ..... 70/33
5,655,392 A * 8/1997 Holmgren ..... 70/57.1
5,812,065 A * 9/1998 Schrott et al. ..... 340/10.34
6,374,647 B1 * 4/2002 Holmgren ..... E05B 73/0017 206/807
6,449,991 B1 * 9/2002 Hogan ..... 70/57.1
7,441,424 B2 * 10/2008 Saitoh et al. ..... 70/19
7,474,222 B2 * 1/2009 Yang et al. ..... 340/572.8
7,481,086 B2 * 1/2009 Fawcett et al. ..... 70/57
7,595,733 B2 * 9/2009 Spagna ..... 340/572.8
D611,862 S * 3/2010 Perez ..... D10/106.91
7,724,146 B2 * 5/2010 Nguyen et al. ..... 340/572.8
8,179,267 B2 * 5/2012 Anderson et al. ..... 340/572.9
8,733,138 B2 * 5/2014 Favier ..... E05B 73/0017 70/19
2007/0296597 A1 * 12/2007 Nizzola ..... 340/572.8
2008/0061987 A1 * 3/2008 Kolton ..... E05B 73/0035 340/572.9
2010/0171620 A1 * 7/2010 Stoltz et al. ..... 340/572.9
2010/0287998 A1 * 11/2010 Anderson et al. ..... 70/57.1
2012/0073336 A1 * 3/2012 Thoonsen ..... 70/19

FOREIGN PATENT DOCUMENTS

EP 385540 A1 * 9/1990 ..... E05B 73/00
GB 2180680 A * 4/1987 ..... G08B 13/14

* cited by examiner

*Primary Examiner* — Christopher Boswell
*Assistant Examiner* — Eric Kurilla
(74) *Attorney, Agent, or Firm* — Milford A. Keshishian

(57) ABSTRACT

An anti-theft tag that has a fixed component and a moving component, with the moving component moved to frictionally clamp and secure the anti-theft tag onto an article without damaging the article.

16 Claims, 18 Drawing Sheets

ANTI-THEFT DEVICE

CROSS-REFERENCE TO RELATED APPLICATIONS

This Application claims the benefit of priority of the U.S. Utility Provisional Patent Application No. 61/443,697, filed on Feb. 16, 2011, the entire disclosure of which is expressly incorporated by reference herein.

BACKGROUND OF THE INVENTION

1. Field of the Invention

The invention is related to loss prevention and Electronic Article Surveillance (EAS) and, more particularly, to an EAS tag that secure onto an article and allow the presence of this article to be detected by compatible EAS equipment.

2. Description of Related Art

It is a common practice for retail stores to protect articles with EAS tags to prevent theft of the article by shoplifters. There are several methods of tagging articles or merchandise, most common of which is attaching an EAS tag or EAS labels using adhesive, pins, lanyards or straps to trigger the EAS security system resulting in an alarm. The EAS labels are easy to remove while the cables or strapped tags are sometimes bulky or obtrusive to the person trying on the protected merchandise like a pair of shoes or boots to determine the fit. This makes the trying on process inconvenient and ineffective. In other words, for most instances, the EAS tag must be removed by an authorized person before a buyer can try on the article. Further to this, the cables or straps used to attach the conventional tag to the merchandise can be cut which then makes it easy for shoplifters to remove these tags, rendering the article unsecure and unprotected.

There remains a long standing and continuing need for an advance in the art of EAS and theft deterrent tags that makes the tags more difficult to defeat, simpler in both design and use, more economical and efficient in their construction and use, and provide a more secure and reliable engagement of the article to be monitored without damaging or permanently altering the article.

BRIEF SUMMARY OF THE INVENTION

A non-limiting, exemplary aspect of the present invention provides an anti-theft tag, comprising: a fixed component and a moving component, with the moving component moved to frictionally clamp and secure the anti-theft tag onto an article without damaging the article.

Another non-limiting, exemplary aspect of the present invention provides an EAS tag, comprising: a fixed component and a moving component, with the moving component moved to frictionally clamp and secure the anti-theft tag onto an article without damaging the article. The fixed component is comprised of a body, a shoulder, and a cantilever arm that define a gap with substantially "U" shaped profile for securing the article therein, with the body including a through-hole for insertion of the moving component.

Still another non-limiting, exemplary aspect of the present invneiton provides an EAS tag, comprising a fixed component having a gap with substantially "U" shaped profile for securing an article therein the gap, and a moving component with a grip portion that contacts the article for frictionally clamping and securing the article within the gap.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The present invention provides an Electronic Article Surveillance (EAS) tag that overcomes the disadvantages of the conventional tags, including providing an EAS anti-theft tag that is cost-efficient, durable, compact, is detachable when used with an authorized detaching unit, and can be attached to an item to be monitored without damaging or permanently altering the item.

The EAS device of the present invention can be quickly and easily secured to an article made of varying materials, dimensions, and configurations to prevent the unauthorized removal of the article, is a rugged theft deterrent unit to permit the repeated use thereof, and provides a quick engagement and disengagement feature. Further, and in keeping with the principles of the present invention, a unique EAS theft deterrent tag is disclosed wherein the tag is capable of engaging articles that are to be monitored without necessitating the puncture of the articles, for example, with a pin. In addition, by providing an adjustable attachment mechanism, labor, time, and costs are reduced when attaching or removing the tag from a variety of sizes of article being protected thereby.

The present invention provides a more secure attachment by using a low profile (small form-factor), EAS ferrite embedded, durable Acrylonitrile Butadiene Styrene (ABS) tag that conveniently detachably attaches to the merchandise by frictionally clamping onto the article without damaging it. The article then becomes more secure, more convenient to try on (while the tag is still attached) because of the tag small form-factor and therefore, the article itself becomes more marketable. The EAS tag of the present invention can also be used with any other merchandise where the EAS tag can frictionally grip onto the article.

In particular, and as detailed below, the EAS tag of the present invention has a quick install mechanism that is pressed and rotated to tightly and frictionally secure the merchandise, has a quick release mechanism that automatically retracts when the tag is placed on an appropriate magnetic detacher, and a rotating thumb dial that is rotated to prepare the EAS tag for the next install.

Figure 1A:
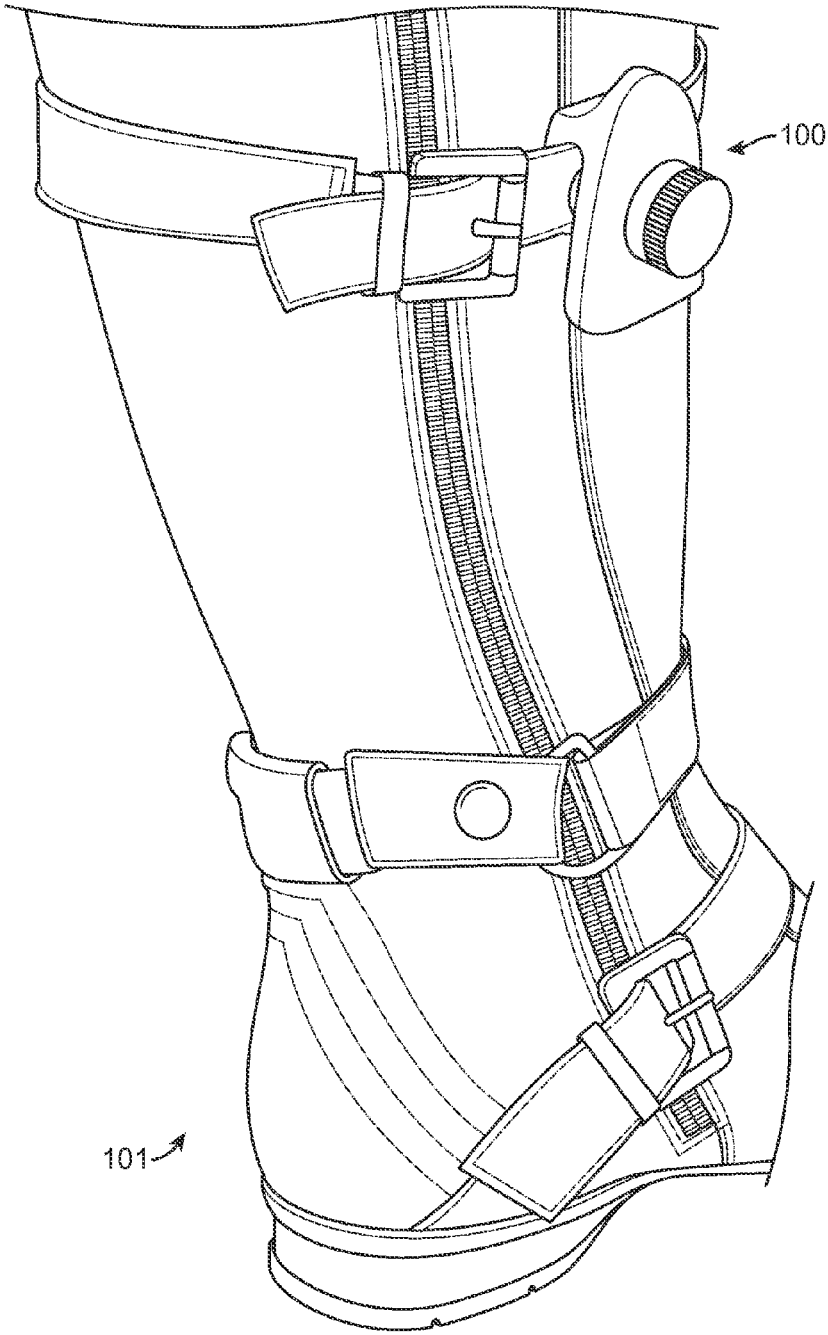
FIGS. 1A and 1B are non-limiting, exemplary illustrations of an EAS tag mounted onto a non-limiting, exemplary article in accordance with the present invention.
Figure 1B:
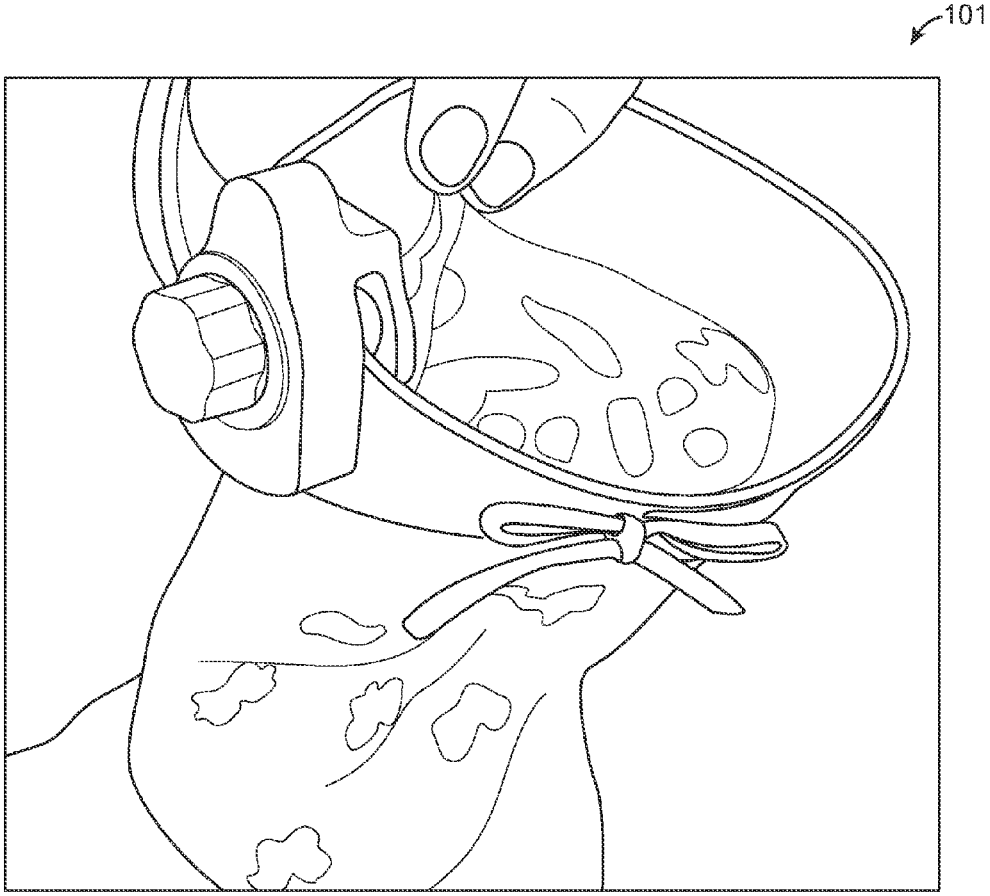
Figure 1C:
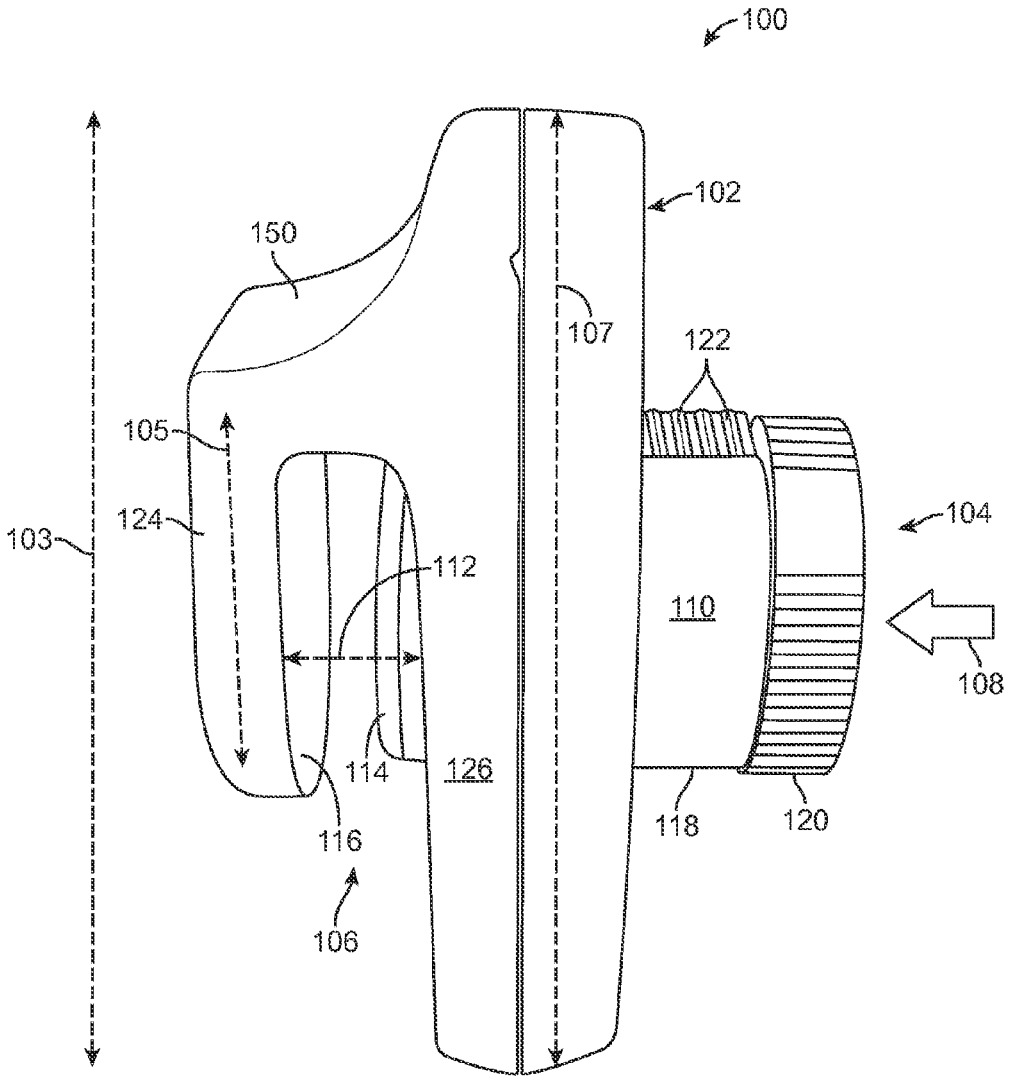
FIGS. 1C to 1G are non-limiting, exemplary illustrations of the various views of the EAS tag illustrated in FIGS. 1A to 1B in accordance with the present invention.
Figure 1D:
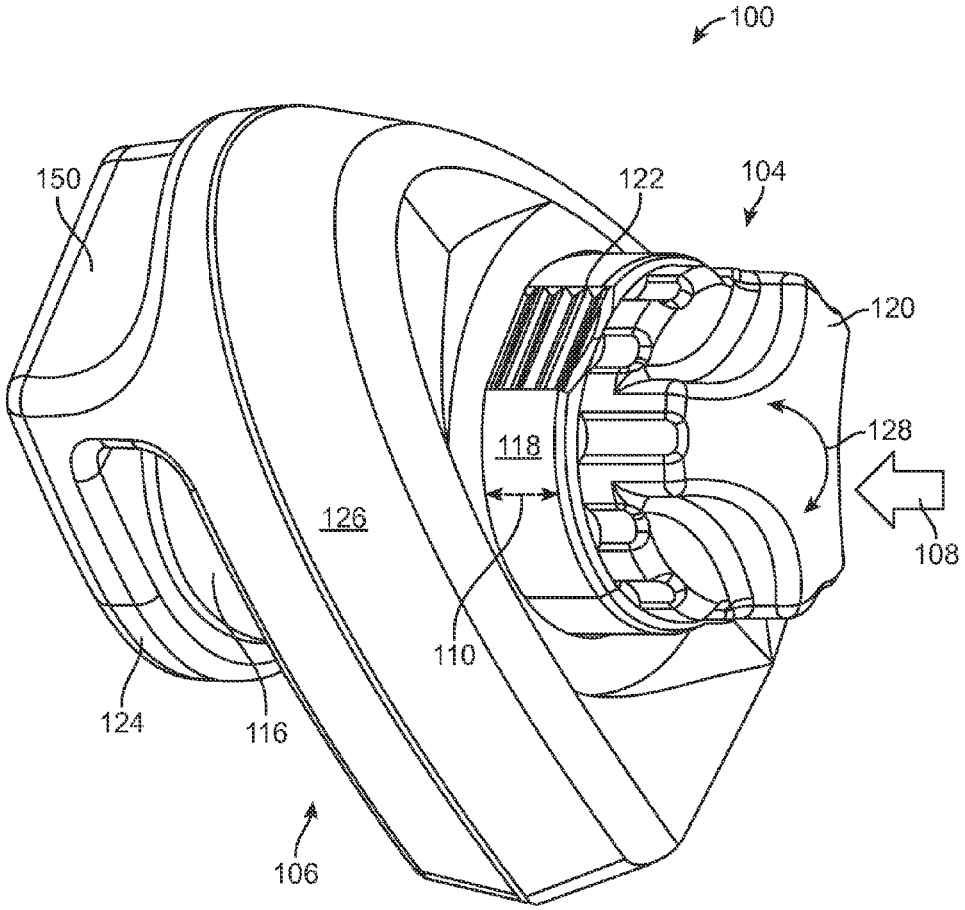
Figure 1E:
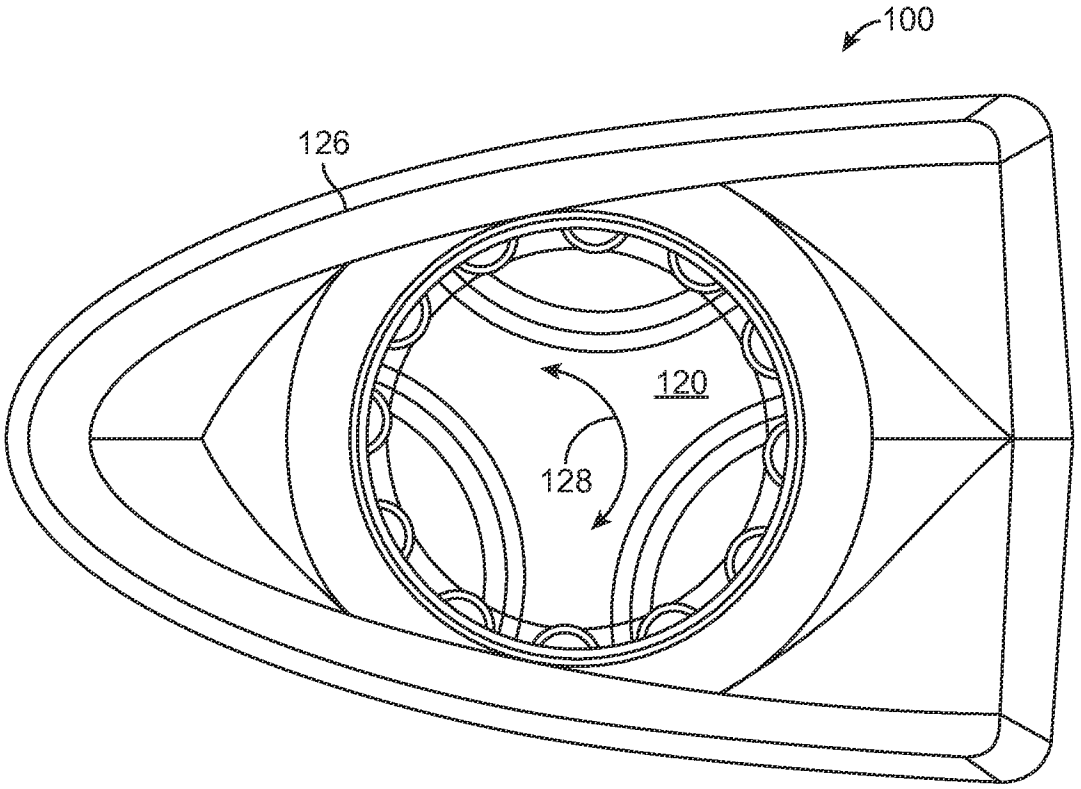
Figure 1F:
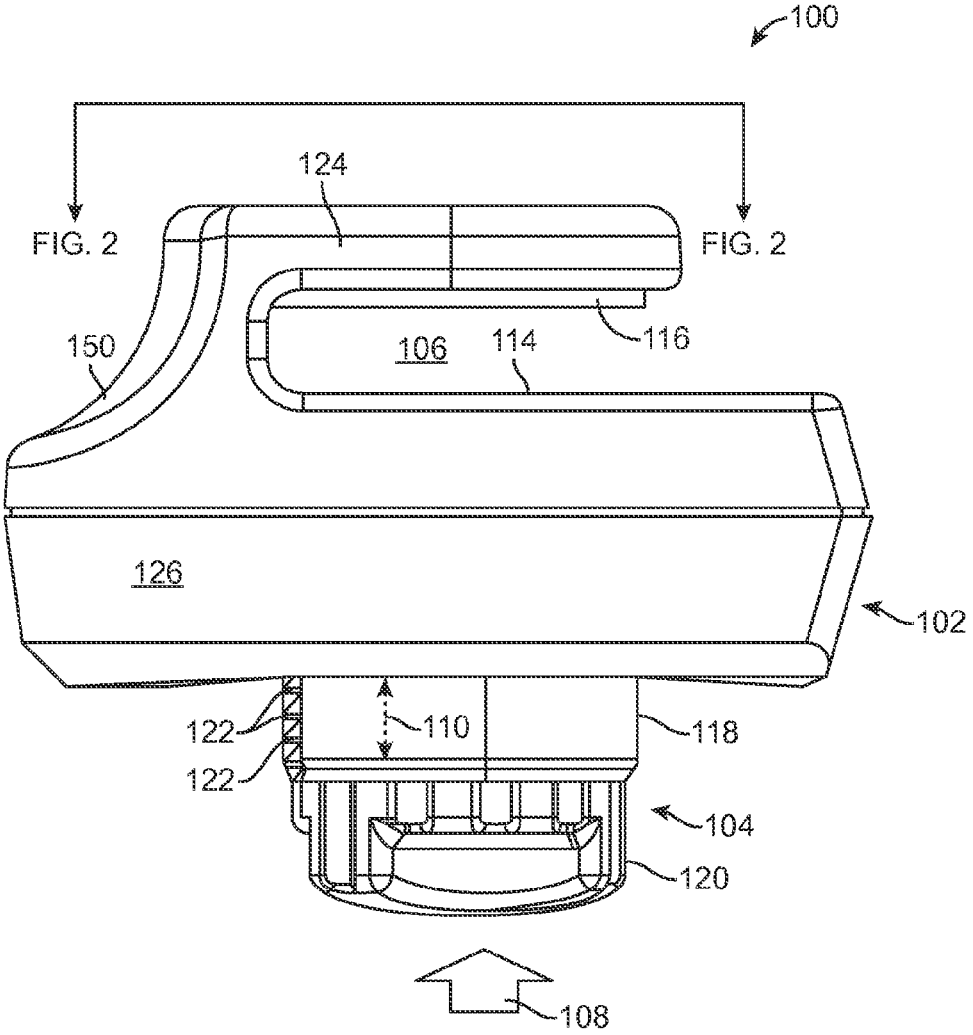
Figure 1G:
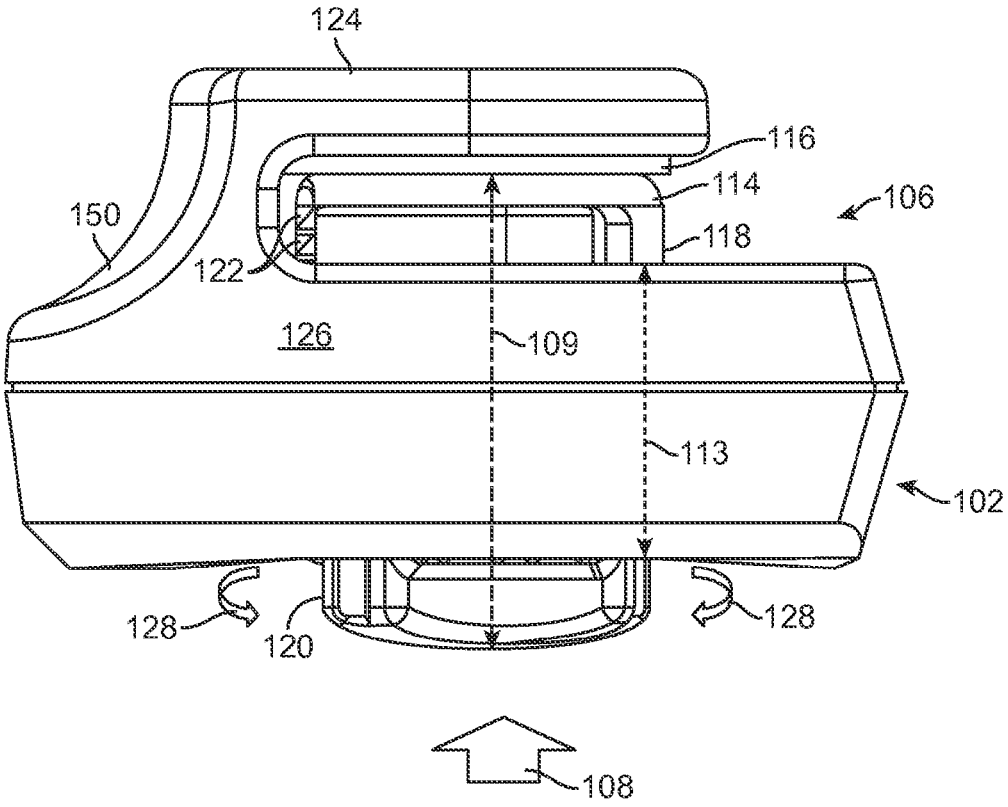

FIGS. 1A and 1B are non-limiting, exemplary illustrations of an EAS tag mounted onto a non-limiting, exemplary article in accordance with the present invention. As illustrated in FIGS. 1A and 1B, the EAS tag 100 of the present invention has a low profile (small form-factor) that conveniently detachably attaches to the merchandise (boot 101) by frictionally clamping onto the article 101 without damaging it. The article 101 then becomes more secure, more convenient for fitting (to try on by a potential buyer while the EAS tag 100 is still attached) because of the EAS tag 100 small form-factor. Therefore, the article 101 itself becomes more marketable in that a potential buyer can easily try on the article 101 for fitting while the EAS tag 100 is still attached without requiring the removal of the EAS tag 100. The EAS tag 100 of the present invention can also be used with any other merchandise where the EAS tag 100 can frictionally and securely grip onto the article.

Figure 4A:
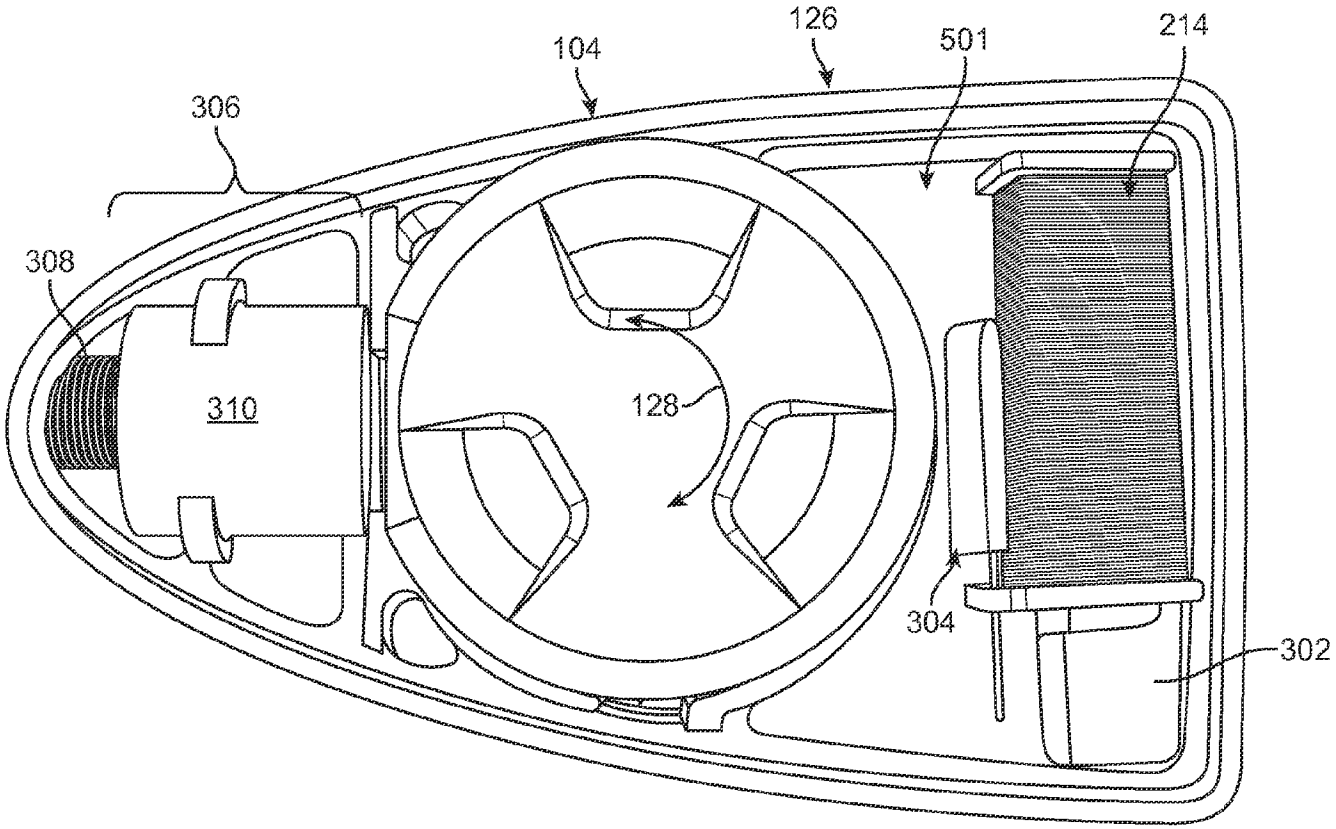
FIGS. 4A to 4G are non-limiting, exemplary illustrations of the housing, and internal components of the EAS tag of FIGS. 1A to 3C in accordance with the present invention.
Figure 4B:
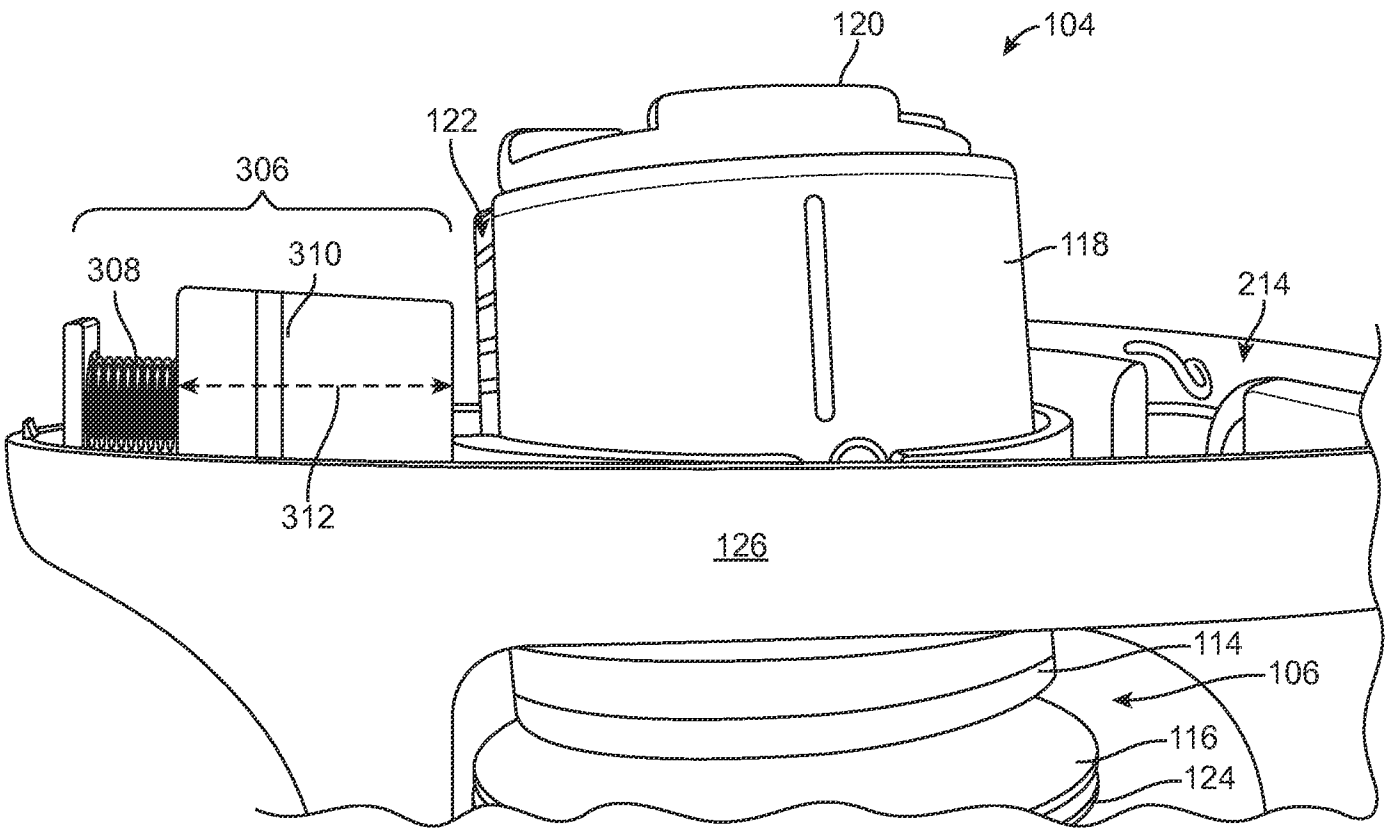

FIGS. 1C to 1G are non-limiting, exemplary illustrations of the various views of the EAS tag illustrated in FIGS. 1A to 1B in accordance with the present invention. As best illustrated in FIGS. 1C to 1G, the EAS tag 100 of the present invention is comprised of a fixed component 102 and a moving component 104, with the moving component 104 moved along the reciprocating path 110 to frictionally clamp and secure the EAS tag 100 onto an article within a gap 106 without damaging the article. That is, as the moving component 104 is pressed by an external force 108, the component 104 moves along the reciprocating path 112 within the gap 106 to close the gap 106 between a grip portion 114 of the moving component 104 and the base-support portion 116 of a cantilever arm 124 to secure an article in between within the gap 106. The moving component 104 maintains its desired position by a set of serrations 122 that interlock with a locking mechanism 306 (FIG. 4A) that is housed within a body 126 of the fixed component 102.

As further illustrated, the fixed component 102 is comprised of a body 126, a shoulder portion 150 that extends substantially transverse a longitudinal axis 103 of EAS tag 100, and the cantilever arm 124 coupled with the shoulder portion 150 that extends substantially parallel the longitudinal axis 103. The cantilever arm 124 has a length 105 that is optionally shorter than the length 107 of the body 126. The body 126, shoulder 150, and the cantilever arm 124 define the gap 106 with substantially "U" shaped profile for securing an article therein. The body 126 includes a through-hole 202 (FIG. 2), transverse the longitudinal axis 103 for insertion of the moving component 104.

Figure 4C:
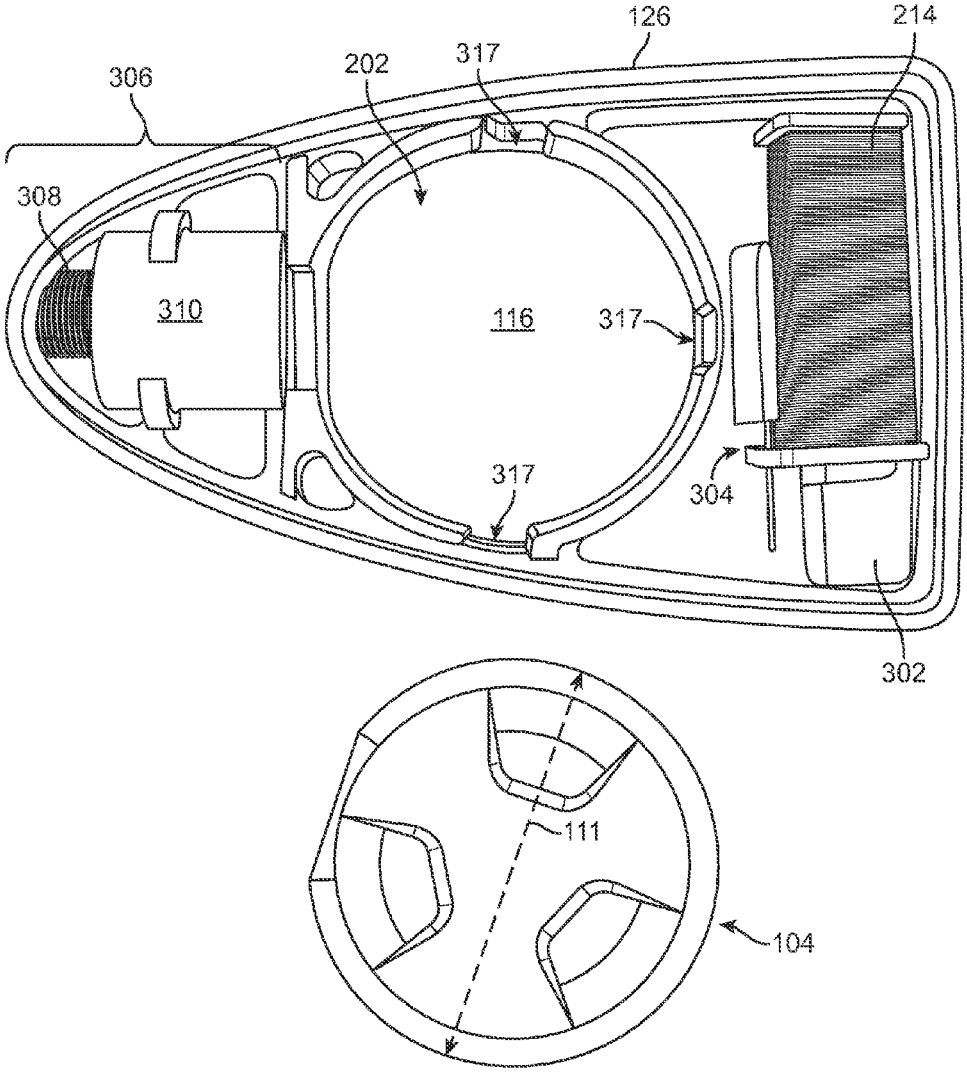
Figure 4D:
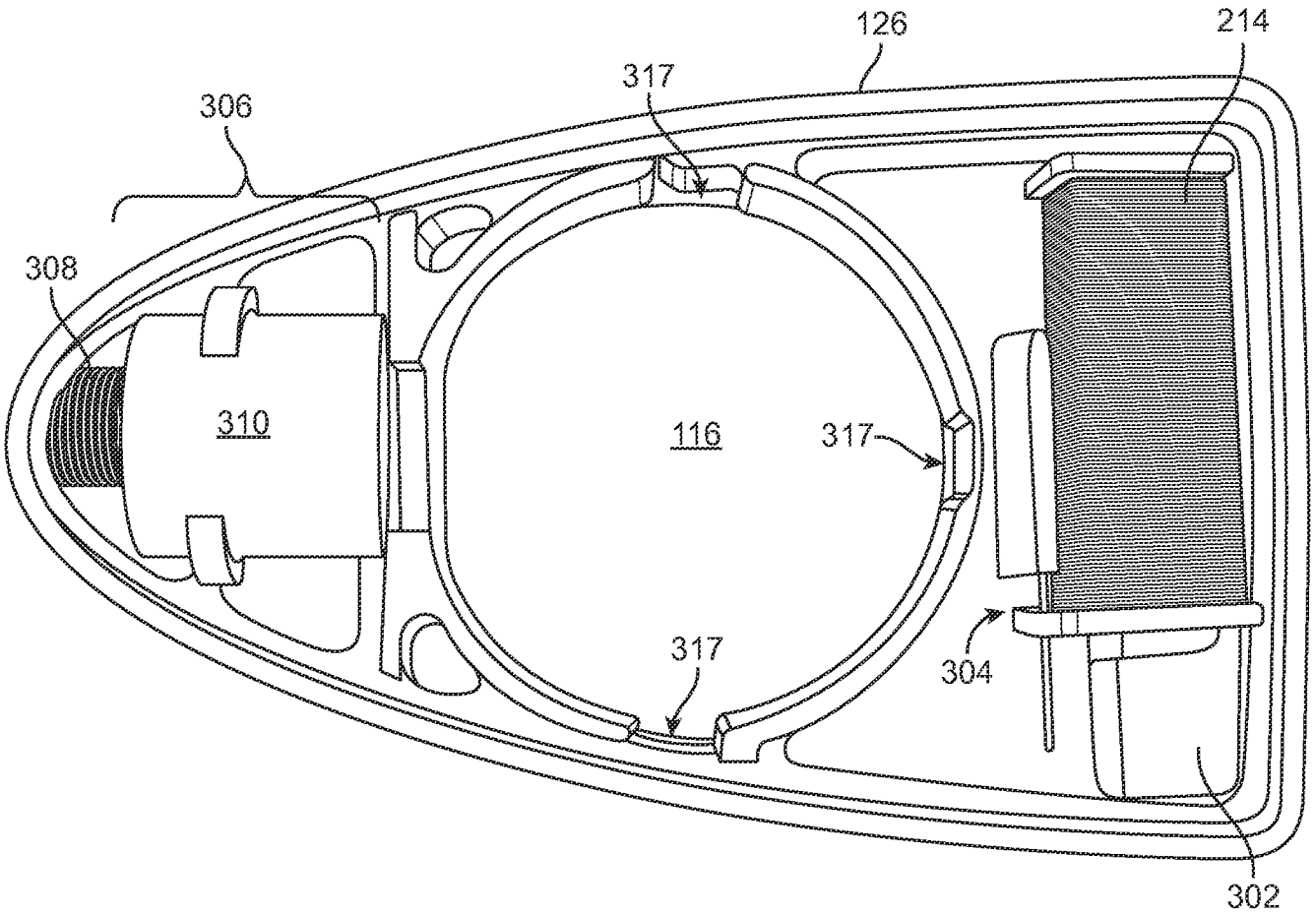
Figure 4E:
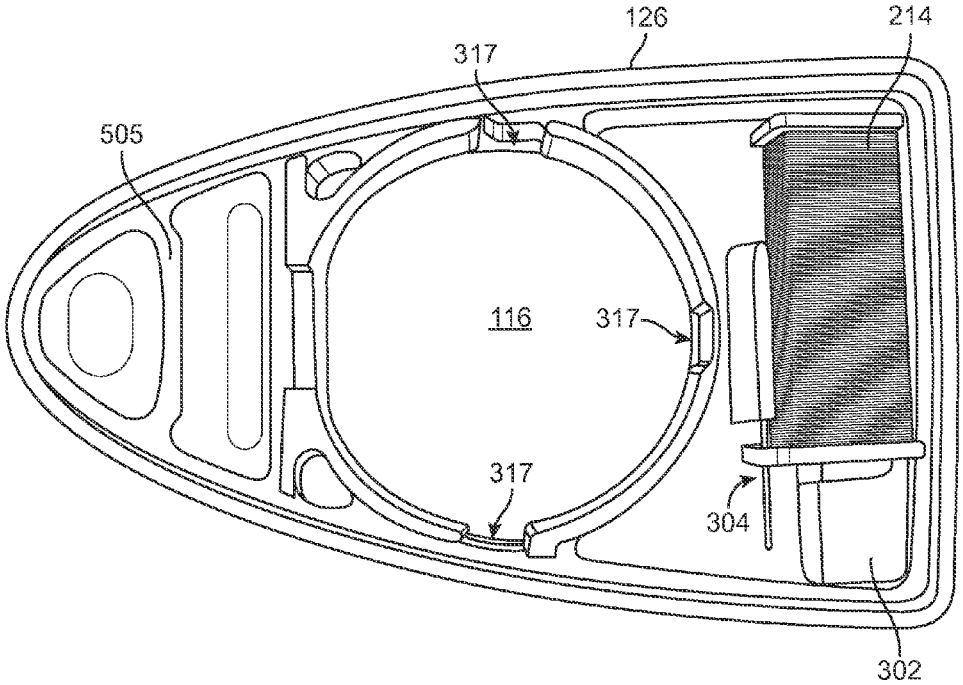
Figure 4E:
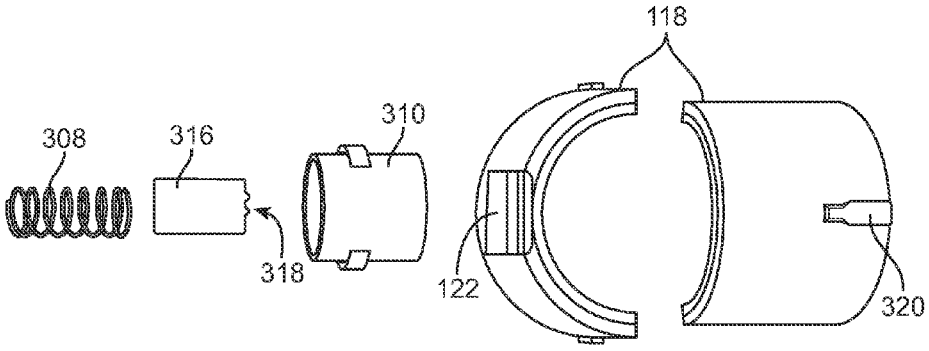
Figure 4F:
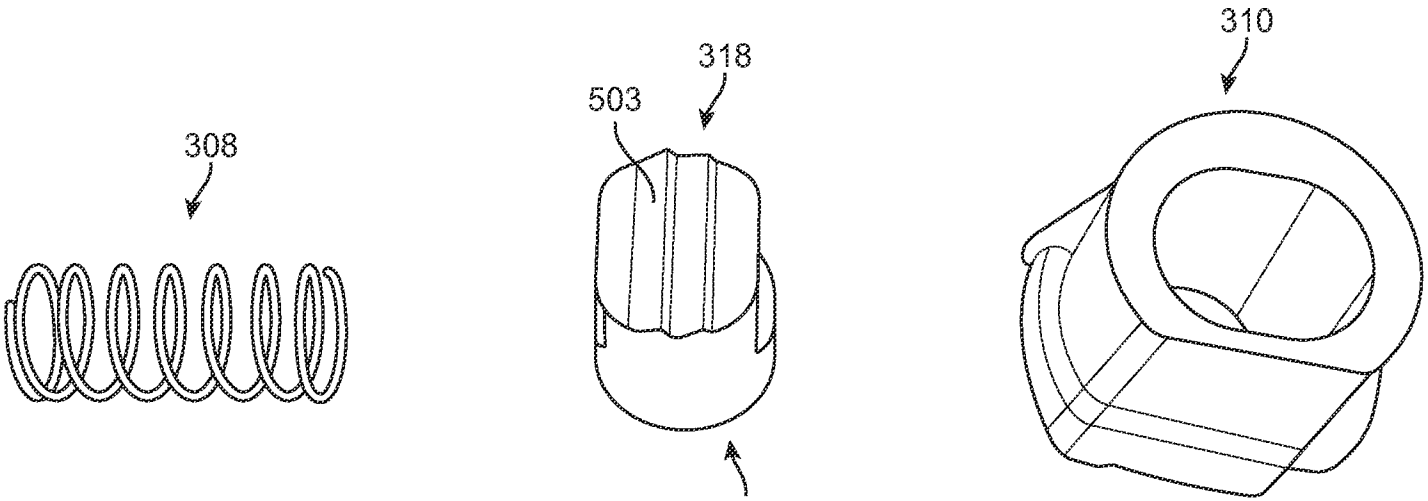
Figure 4G:
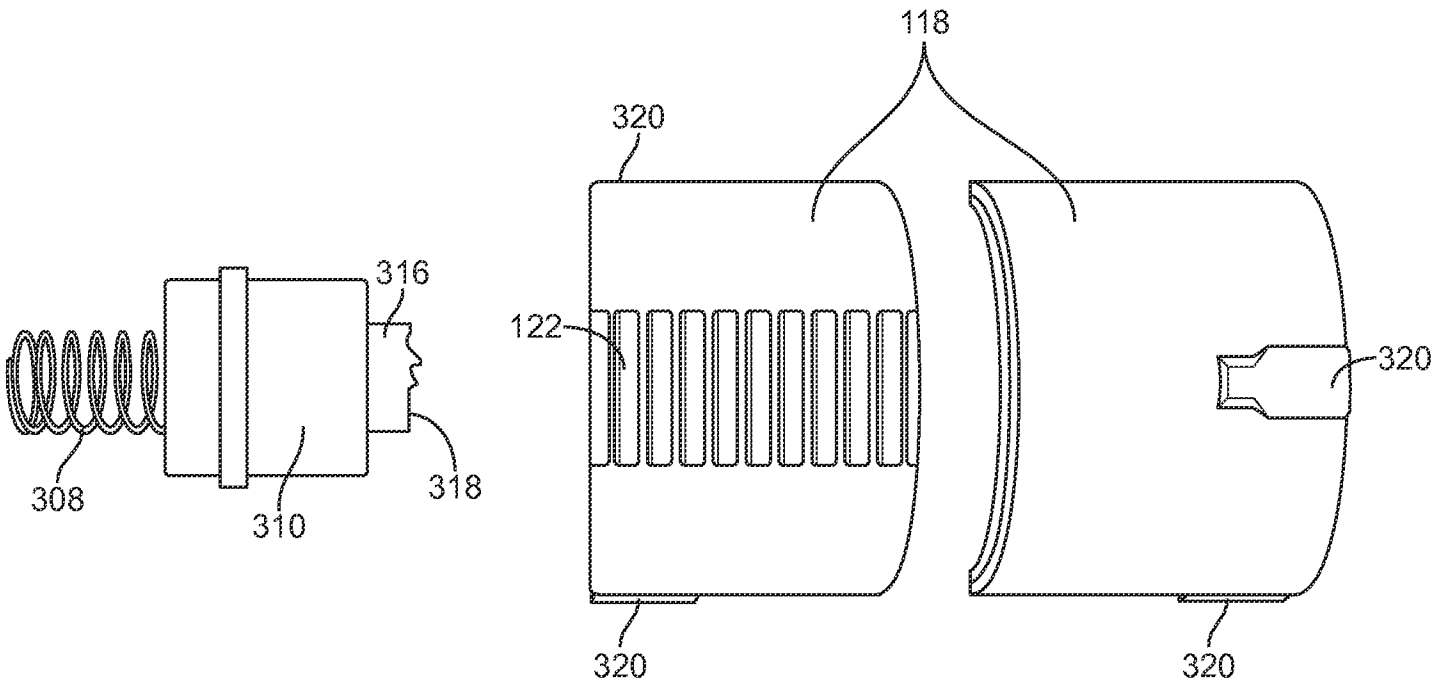

As further illustrated, the moving component 104 has a length 109 (FIG. 1G) and a width 111 (FIG. 4C), with the length 109 of the moving component 104 having a span that is greater than the length 113 (FIG. 1G) of the through-hole 202 of the fixed component 102. The moving component 104 is comprised of the grip portion 114 that contacts the article with which the EAS tag 100 is coupled for frictionally clamping and securing the article in the gap 106. The moving component 104 further includes a piston 118 that has a translational movement that enables the moving component 104 to move along the reciprocating path 110 though the through-hole 202. Further included along the exterior surface of the piston 118 are first set of interlocking beveled serrations 122 that are oriented complementary in relation with a second set of interlocking beveled serrations 318 (FIG. 4E) of a lock mechanism 306 to lock the moving component 104 at a desired position. As further illustrated in FIG. 2, the piston 118 accommodates a moving subcomponent 204 that pivotally extends translationally along the path 112 within the gap 106 by a rotating mechanism (pivoting knob) 120 to further tighten the grip portion 114 contact with the article.

Figure 2:
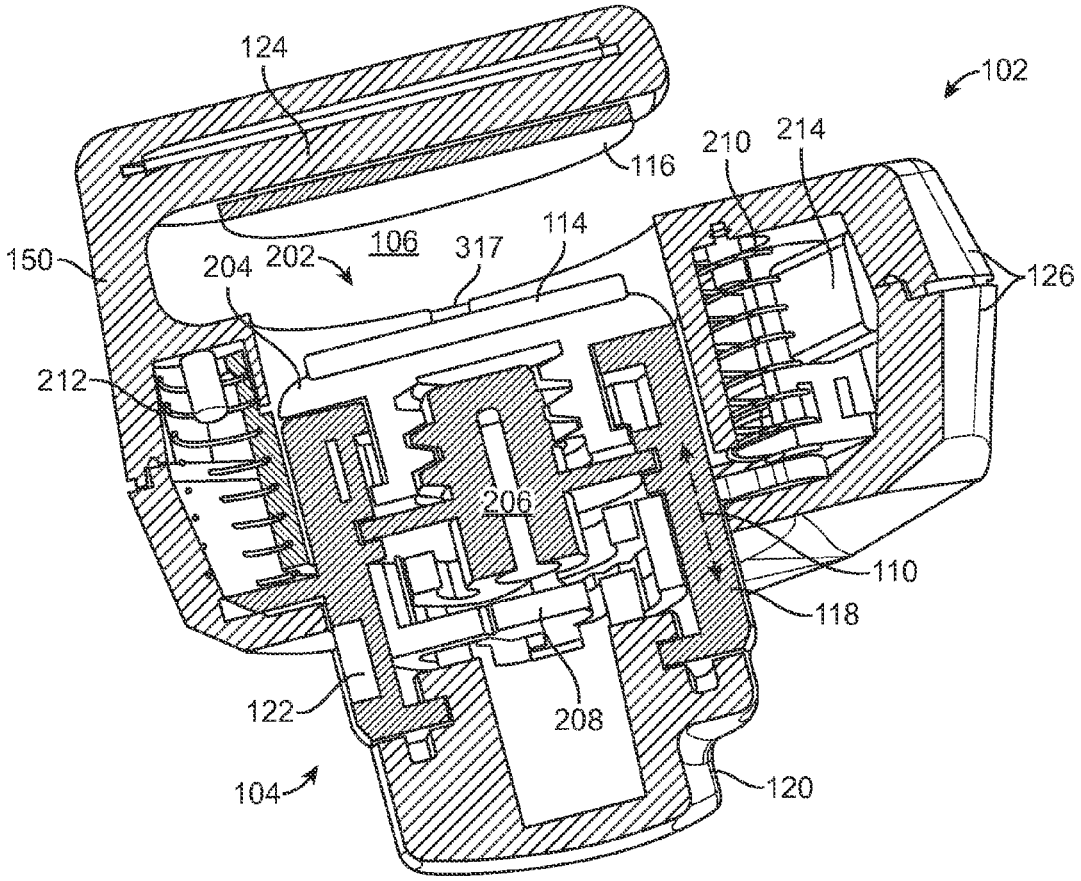
FIG. 2 is a non-limiting, exemplary schematic illustration of a cross-sectional view of the EAS tag illustrated in FIGS. 1A to 1G in accordance with the present invention.

As further illustrated in FIG. 2, the rotating mechanisms is comprised of the pivoting knob 120 that when rotated along a reciprocating path 128 (FIG. 1E) moves the subcomponent 204 to one of open and closed orientations by a first and second intermediate members 208 and 206. That is, as the pivot knob 120 is rotated, the subcomponent 204 rotates and "unwinds," with the grip portion 114 moving closer towards the base-support portion 116 (i.e., the "closed" orientation) for a tighter grip with the article.

Figure 3A:
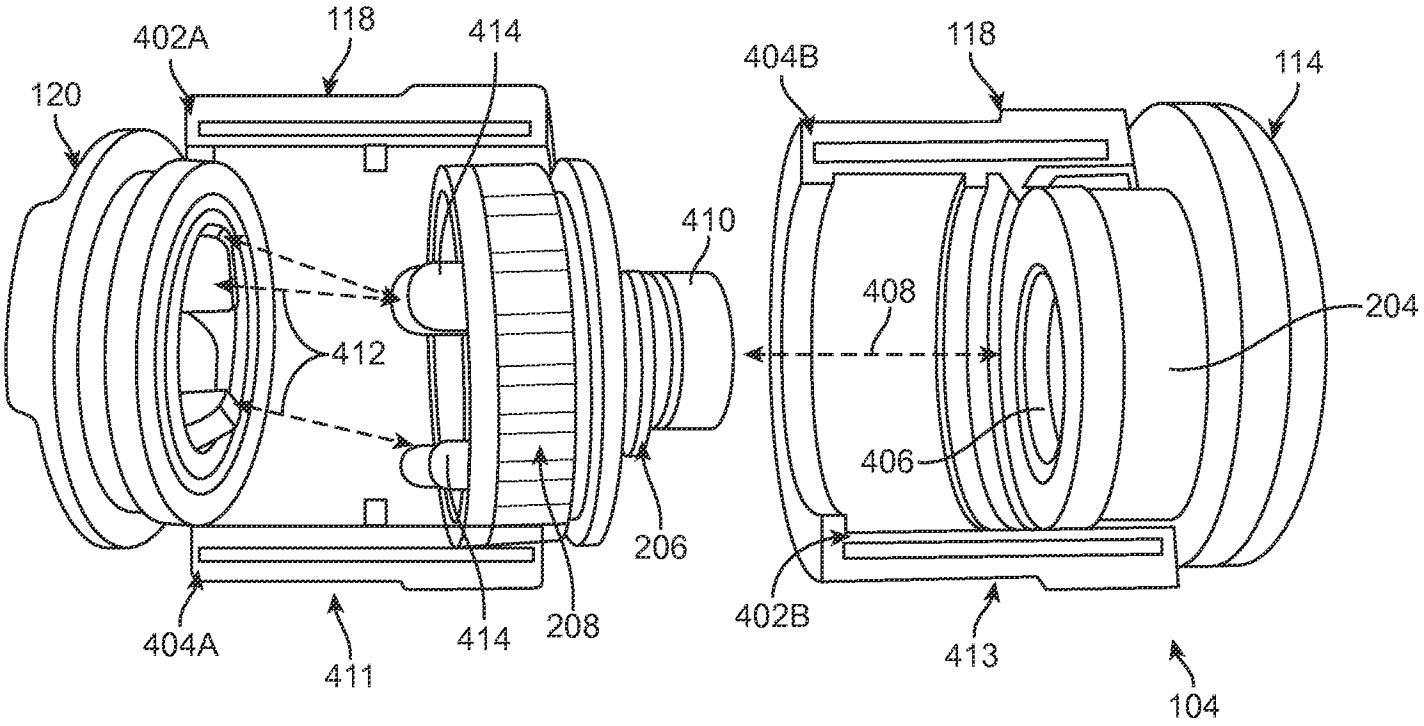
FIG. 3A is a non-limiting, exemplary illustration of a moving component of the EAS tag split into two pieces, illustrating intermediate members within the moving component in accordance with the present invention.

FIG. 3A is a non-limiting exemplary illustration of the moving component of the EAS tag, illustrating the intermediate members within the moving component in accordance with the present invention. As illustrated, the moving component 104 in FIG. 3A is split open into two pieces 411 and 413, with the second piece 413 rotated to illustrated the internal structure. That is, when put together, the corner 402A of the first piece 411 and the corner 402B of the second piece come together, and corner 404A of the first piece 411 and the corner 404B of the second piece 413 come together.

Figure 3B:
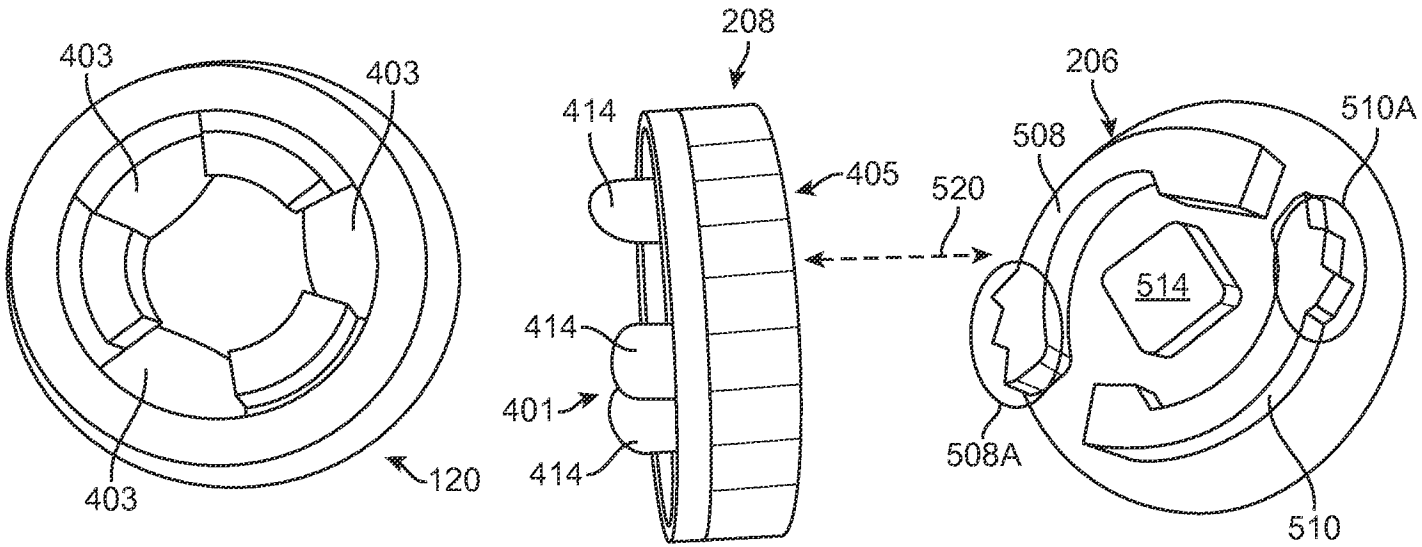
FIGS. 3B and 3C are non-limiting, exemplary illustrations of the various views of the intermediate members in accordance with the present invention.
Figure 3C:
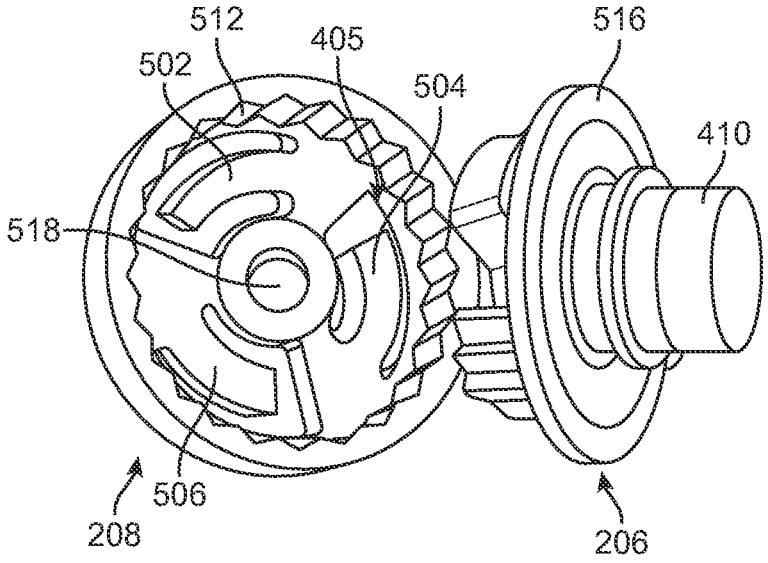

As best illustrated in FIGS. 3A to 3C, the first intermediate member 208 is comprised of a first side 401 (FIG. 3B) that has a set of protuberances 414 coupled with first set of flanges 502, 504, 506 (with a common center 518 illustrated in FIG. 3C), with the protuberances 414 interlocking (shown by arrows 412 in FIG. 3A) with complementary set of cavities 403 located on the knob 120. The first intermediate member 208 further includes a second side 405 (FIGS. 3B and 3C) that accommodates the second intermediate member 206 in orientation shown by the arrow 520.

The second intermediate member 206 includes first and second flanges 508 and 510 with distal ends 508A and 510A that are serrated and contact and interlock with a serrated periphery inner wall 512 of the second side 405 of the first intermediate member 208. The second intermediate member 206 further includes a threaded male connector 410 (FIG. 3C) on a side 516 thereof that couples with complementary threaded female connector 406 of the moving subcomponent 204. When the pivot knob 120 is rotated, the first intermediate member 208 rotates, which turns the second intermediate member 206 to "threadingly" (via the threaded connections 410 and 406) rotate to move (along reciprocating path 408) the moving subcomponent 204 toward a closed position to further tighten grip of the grip portion 104 onto the article. Rotation of the first intermediate member 208 in a first direction (e.g., clockwise) engages the first intermediate member serrations 512 with the second intermediate member serrations 508A/510A, forcing the second intermediate member 206 to rotate. In other words, due to orientation of the serrations 508A/510A on the flanges 508 and 510 of the second intermediate member 206, the first and second intermediate members 208 and 206 engage and interlock at their respective serrations at first direction (e.g., clockwise), which results in interlocked, simultaneous movement of the first and second intermediate member 208 and 206.

The respective first and second intermediate members 208 and 206 prevent loosening the already tightened pivot knob 120 when the EAS tag 100 is on the merchandise because rotating the pivot knob 120 in a second direction (e.g., counterclockwise) prevents the first and second intermediate members 208 and 206 from interlocking within one another via their respective serrations 512 and 508A/510A. In other words, due to orientation of the serrations 508A/510A on the flanges 508 and 510 of the second intermediate member 206, the first and second intermediate members 208 and 206 frictionally engage, but do not interlock when rotated in the second direction (e.g., counterclockwise), which results in free movement of the second intermediate member 206 inside the first 208. On the other hand, when rotated in the first direction, the serrations of the first and second intermediate members 208 and 206 interlock to enable the rotation of the second member 206, and further tightening of the gap 106. It should further be noted that if the moving component 104 is released and is not in the locking position (to reduce size of the gap 106), the rotation (e.g., second direction) of the first and second intermediate members 206 and 208 will result in withdrawal of the subcomponent 204 from its extended position. Further to this, several combinations of this same mechanism can be incorporated in reverse direction from each other thereby creating a tension regulator that only allows the device to be tightened onto the merchandise only to a certain predesigned pressure. This facilitates application of appropriate level of pressure onto delicate merchandise, while maintaining secure hold of the article.

As best illustrated n FIGS. 2 and 4A to 4G, the body 126 includes a cavity 501 that accommodates the electronic surveillance system components that includes at least one exemplary resonant circuit for disruption of a detecting field for sounding an alarm. Non-limiting example of a resonant circuit includes a ferrite 214, ferrite core 302, and a capacitor 304 tuned to resonance. It should be noted that one or more transponders that receive or send signals and that may trigger an internal and or an external alarms in case of an unauthorized removal of an article from a secure surveillance zone may be used and accommodated within the cavity 501. Each of the one or more transponder antennas may be tuned to a different resonant frequency for activation of different types of EAS systems, non-limiting examples of which may include AM, RF, Microwave, and etc.

As further illustrated in FIGS. 4A to 4G, the cavity 501 further houses the interlocking mechanism 306 within the chamber 505 (FIG. 4E) with the interlocking mechanism 306 comprising a biasing mechanism 308 that biases a first side 318 of a clutch 316 with serrations 503 against the serrations 122 of the piston 118, with first side 318 of the clutch 316 and the piston 118 having complementary oriented beveled serrations 503 and 122 that interlock to maintain the desired gap closure. The clutch 316 is accommodated in a clutch housing 310. The body 126 further includes a set of guiding notches 317 that enable the guiding protuberances 320 (FIG. 4E) of the moving component 104 to move along a reciprocating path 110 within the though-hole 202, preventing the moving component 104 form wobbling while being moved. The cavity 501 further accommodates a set of lateral biasing mechanisms 210 and 212 (FIG. 2) that bias and support the moving component 104 at a default open orientation, defining the open gap 106. That is, when the moving component 104 is pushed to reduce the size of the gap 106, the serrations 122 interlock with the serration 503 (FIG. 4G) of the clutch 316 to lock the moving component 104 at desired position against the biasing force of the lateral biasing mechanism 210 and 212. Please note that in FIGS. 4E and 4G, the piston 118 is split into two for illustrating the various aspects of the piston for better understanding and clarity. A magnetic detacher may be used to release and pull back the clutch 316 from its biased position, and out and away from the serrations 122 of the moving component 104 to release moving component 104 to its default open position. To disengage the clutch 316, the engaging surface 318 is retracted, released, and disengaged from the interlocked and engaged position with the serrations 122 when the magnetic detacher overcomes the force exerted by the resilient member 308. That is, the engaging surface 318 is released, retracted and disengaged from the interlock serrations 122 when the force exerted by the resilient member 308 is reversed, with the reversed force pulling the engaging surface 318 out and away from the interlock serrations 122, against the biasing mechanism 308. That is, to release an article, the clutch housing 310 (i.e., the chamber 505 of the body 126) is brought into physical contact with well-known suitable (in terms of magnetic strength, for example) magnetic detacher that enables the release and removal of the engaging surface 318 from the serrations 122. The magnetic detacher magnetically pulls-in the clutch 316 in the reciprocating path 312 against the push of the biasing mechanism 308 (compresses the illustrated spring 308) to thereby pull-out the engaging surface 318 away from the serrations 122. The release of the clutch 316 enables the moving component 104 to move to its default, open position by the aid of the biasing members 210 and 212.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the tag can be used on leather goods with just a change in the frictional material, or the tag can be modified so the frictional surface has miniature pins in them to allow use on fabrics and the like. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of in the claims herein is not intended to invoke the provisions of 35 U.S.C. 112, Paragraph 6.

What is claimed is:

1. An anti-theft tag, comprising:

a fixed component and a moving component, with the moving component moved to frictionally clamp and secure the anti-theft tag onto an article without puncturing the article;

the moving component having a movable subcomponent that is moved to extend away from the moving component to provide a tighter grip of the moving component with the article;

the moving component is comprised of:

a grip portion that contacts the article with which the anti-theft tag is coupled for frictionally clamping and securing the article; and a piston that has a translational movement that enables the moving component to move through a through-hole and via a set of complementary oriented beveled serrations interlock with a lock mechanism at a desired position;

the piston further includes the moving subcomponent that pivotally extends by a rotating mechanism to further tighten the grip portion contact with the article.

2. The anti-theft tag as set forth in claim 1, wherein:

the fixed component is comprised of:

a body;

a shoulder portion that extends substantially transverse a longitudinal axis of the body, and a cantilever arm coupled with the shoulder portion that extends substantially parallel the longitudinal axis of the body;

the body has length, width, and thickness;

the body, shoulder, and the cantilever arm define a gap with substantially "U" shaped profile for securing the article therein;

the body includes a through-hole, transverse the longitudinal axis of the body for insertion of the moving component.

3. The anti-theft tag as set forth in claim 1, wherein:

the moving component has a length and a width, with the length of the moving component having a span that is greater than a length of the through-hole of the fixed component.

4. The anti-theft tag as set forth in claim 1, wherein:

the rotating mechanism is comprised of a pivoting knob that when rotated moves the subcomponent to one of open and closed orientations by a first and second intermediate members.

5. The anti-theft tag as set forth in claim 4, wherein:

the first intermediate member is comprised of:

a first side that interlocks with the pivoting knob, a second side that accommodates the second intermediate member.

6. The anti-theft tag as set forth in claim 5, wherein:

the second intermediate member includes first and second flanges and with distal ends that are serrated and contact and interlock with a serrated periphery inner wall of the second side of the first intermediate member, and a threaded male connector that couples with a complementary threaded female connector of the moving subcomponent.

7. The anti-theft tag as set forth in claim 6, wherein:

rotating the knob rotates the first intermediate member, which turns the second intermediate member to rotate and move the moving subcomponent to one of closed and open positions.

8. The anti-theft tag as set forth in claim 1, wherein:

the fixed component is comprised of:

a body;

the body includes a cavity that accommodates:

electronic surveillance system components that includes a resonant circuit for disruption of a detecting field for sounding an alarm.

9. The anti-theft tag as set forth in claim 8, wherein:

the resonant circuit includes a ferrite, ferrite core, and a capacitor tuned to resonance.

10. The anti-theft tag as set forth in claim 8, wherein:

the cavity further includes:

an interlocking mechanism that is comprised of:

a biasing mechanism that biases a first side of a clutch with serrations against serrations of the piston, with first side of the clutch and the piston having complementary oriented beveled serrations.

11. The anti-theft tag as set forth in claim 8, wherein:

the cavity further includes:

guiding notches that enable the moving component to move along a reciprocating path within a through-hole of the body; and a set of lateral biasing mechanisms that bias and support the moving component at a default open orientation, defined when a gap is open.

12. An anti-theft tag, comprising:

a fixed component and a moving component, with the moving component moved to frictionally clamp and secure the anti-theft tag onto an article without puncturing the article;

the fixed component is comprised of:

a body, a shoulder, and a cantilever arm that define a gap with substantially "U" shaped profile for securing the article therein;

with the body including a through-hole for insertion of the moving component;

the moving component includes a movable subcomponent that is moved to extend away from the moving component to provide a tighter grip of the moving component with the article;

the moving component is comprised of:

a grip portion that contacts the article with which the anti-theft tag is coupled for frictionally clamping and securing the article; and a piston that has a translational movement that enables the moving component to move through the through-hole and via a set of complementary oriented beveled serrations interlock with a lock mechanism at a desired position;

the piston further includes the moving subcomponent that pivotally extends by a rotating mechanism to further tighten the grip portion contact with the article.

13. Anti-theft tag, comprising:

a fixed component and a moving component, with the moving component moved to frictionally clamp and secure the anti-theft tag onto an article without puncturing the article;

the moving component having a movable subcomponent that is moved to extend away from the moving component to provide a tighter grip of the moving component with the article;

guiding notches that enable the moving component to move along a reciprocating path within a through-hole of a body of the fixed component; and a set of lateral biasing mechanisms that bias and support the moving component at a default position, and an interlocking mechanism that includes:

a biasing mechanism that biases a first side of a clutch with serrations against serrations of the moving component, with first side of the clutch and the moving component having complementary oriented beveled serrations.

14. The anti-theft tag as set forth in claim 13, wherein:

the body includes a cavity that houses electronic surveillance system components that includes a resonant circuit for disruption of a detecting field for sounding an alarm.

15. The anti-theft tag as set forth in claim 14, wherein:

the resonant circuit includes a ferrite, ferrite core, and a capacitor tuned to resonance.

16. The anti-theft tag as set forth in claim 13, wherein:

the clutch is housed inside a clutch housing positioned within the fixed component.

* * * * *